US006109955A

United States Patent [19]

Hanazaki et al.

[11] Patent Number: 6,109,955

[45] Date of Patent: Aug. 29, 2000

[54] LOCK-DETECTING CONNECTOR

[75] Inventors: Hisashi Hanazaki; Takao Suzuki, both of Shizuoka, Japan

[73] Assignee: Yazaki Corporation, Tokyo, Japan

[21] Appl. No.: 09/110,461

[22] Filed: Jul. 7, 1998

[30] Foreign Application Priority Data

Jul. 8, 1997 [JP] Japan ..... 9-182219

[51] Int. Cl.[7] ..... H01R 3/00

[52] U.S. Cl. ..... 439/489; 439/352

[58] Field of Search ..... 439/488, 489, 439/350–354, 357, 358

[56] References Cited

U.S. PATENT DOCUMENTS

| | | | |
|---|---|---|---|
| 4,946,404 | 8/1990 | Takenouchi et al. | 439/352 |
| 5,203,718 | 4/1993 | Chishima | 439/489 |
| 5,203,719 | 4/1993 | Kozono | 439/489 |
| 5,217,390 | 6/1993 | Nozaki et al. | 439/489 |
| 5,507,666 | 4/1996 | Yamanashi | 439/489 |
| 5,839,915 | 11/1998 | Ford et al. | 439/489 |

FOREIGN PATENT DOCUMENTS

| | | |
|---|---|---|
| 0 655 807 | 5/1995 | European Pat. Off. . |
| 3-285280 | 12/1991 | Japan . |

*Primary Examiner*—Hien Vu

*Attorney, Agent, or Firm*—Armstrong, Westerman, Hattori, McLeland & Naughton

[57] ABSTRACT

A lock-detecting connector capable of surely detecting semi-connection or complete connection thereof is provided. The lock-detecting connector consists of a male connector having a pair of protecting walls on both sides of a locking arm, a female connector having an engaging projection to bend the locking arm and to engage the arm in a resiled state thereof and having an opening for receiving the protecting walls, and a lock-detecting member installed on a rear portion of the male connector, wherein the lock-detecting member has a pair of detecting arms abutting the respective rear ends of the protecting walls. The detecting arms have respective outwardly-facing projections, and front corner-portions formed on both sides of the opening press the outwardly-facing projections inwardly. Slits for receiving the respective outwardly-facing projections are provided on the protecting walls, and upwardly-facing projections for abutting the respective protecting walls are provided on the detecting arms. An interfering portion is provided on a lower portion of the rear end of the locking arm, and a pair of first-stop projections to abut on the locking arm when bent and a second-stop projection to abut the interfering portion are provided on the lock-detecting member. The lock-detecting member has a provisional engaging arm. Thus, a lock-detecting connector capable of surely detecting semi-connection or complete connection thereof is provided.

7 Claims, 9 Drawing Sheets

LOCK-DETECTING CONNECTOR

BACKGROUND OF THE INVENTION

1. Field of the Invention

The present invention generally relates to a connector and more particularly, to a lock-detecting connector which is capable of surely detecting incomplete or complete connection of connectors.

2. Related Art

FIG. 13 shows a prior art lock-detecting connector disclosed in Japanese Patent Application laid-open No. 3,285280 (hereinafter "JP '280").

The lock-detecting connector 61 consists of a male connector 62, a female connector 63, and a lock-detecting member 64, made of synthetic resin, installed on the male connector 62. The connectors 62, 63 are made up of connector housings 65, 66 made of synthetic resin and housing-accommodated terminals 67, 68 (FIG. 14), respectively.

A resilient locking arm 69 having a locking portion 70 at the upper-end is provided on the male connector housing 65. A receiving portion 71 relative to the locking arm 69 is provided on the female connector housing 66, and a downwardly-facing fixed engaging projection 72 (FIG. 14) relative to the locking portion 70 is provided in the receiving portion 71.

The lock-detecting member 64 has a forwardly extending resilient detecting arm 73. An engaging projection 74 is formed at the upper-end of the detecting arm 73. The detecting arm 73 is slidingly inserted along the locking arm 69. The engaging projection 74 can abut on the locking portion 70.

FIG. 14A to 14D show operation of the above lock-detecting connector. As shown in FIG. 14A, at an initial-connection of the connectors, the end of the locking arm 69 abuts the fixed engaging projection 72 on the female connector 63, and then the locking arm 69 bends inwardly integrally with the detecting arm 73 as shown in FIG. 14B. In a semi-connected state of the connectors shown in FIG. 14B, the lock-detecting member 64 can not be further inserted since the engaging projection 74 is abutting the locking portion 70, thereby detecting incomplete connection.

On complete connection of the connectors 62, 63 as shown in FIG. 14C, the locking portion 70 on the locking arm 69 goes over the engaging projection 72 on the female connector 63 and engages the engaging projection 72. As shown in FIG. 14D, the engaging projection 74 on the detecting arm 73 slides under both of the engaging projection 72 and the locking portion 70 by pushing of the lock-detecting member 64, thereby completing insertion of the detecting member 64. Thus, complete connection of the connectors can be detected.

With respect to the above conventional structure of JP '280, however, there is a drawback in that it would be difficult to obtain stable detectability (i.e., abutting force), since the detecting arm 73 bends integrally with the locking arm 69 and the lock-detecting member 64 installed on the male connector 62 is apt to become unstable and bent.

SUMMARY OF THE INVENTION

In view of the foregoing, an object of the present invention is to provide a lock-detecting connector which exhibits sure detectability of semi-connection and complete connection of connectors.

In order to achieve the above object, as a first aspect of the present invention, the present invention provides a lock-detecting connector consisting of: a male connector having a resilient locking arm and a pair of protecting walls on both sides of the locking arm; a female connector having (1) an engaging portion to bend the locking arm and to engage the arm in a resiled state of the arm; and (2) a notched portion for receiving the protecting walls;

a lock-detecting member, installed on a rear portion of the male connector, having a pair of resilient detecting arms to abut on respective rear ends of the pair of protecting walls in a semi-connected state of the male and female connectors, wherein the pair of detecting arms have respective outwardly-facing projections, and front corner-portions formed on both sides of the notched portion are capable of inwardly pressing the outwardly-facing projections to inwardly bend the detecting arms for releasing an abutment of the detecting arms on the rear ends of the protecting walls.

And, as a second aspect of the present invention, the present invention provides the lock-detecting connector wherein a slit for receiving the outwardly-facing projection is provided on each of the protecting walls and an upwardly-facing projection capable of abutting on the protecting walls is provided on each of the detecting arms.

Further, as a third aspect of the present invention, the present invention provides the lock-detecting connector wherein an interfering portion is provided on a lower portion of a rear end of the locking arm, and a pair of first-stop projections to abut on the locking arm when it is bent and a second-stop projection to abut on the interfering portion are provided on the lock-detecting member.

Still further, as a fourth aspect of the present invention, the present invention provides the lock-detecting connector wherein provisional engaging arms are provided between the detecting arms and the first-stop projections, and engagement portions engaging with the provisional engaging arms are provided on the male connector.

According to the present invention as described hereinabove, in a semi-connected state of the connectors, that is, where the locking arm is bent, the pair of detecting arms abut on the pair of protecting walls, thereby making the detecting arms stable and preventing the detecting arms from bending or becoming unstable, and therefore sure detection of the semi-connected state can be performed. And, since the outwardly-facing projections enter the slits by being pushed by the front corner-portions of the female connector, the detecting arms function with a slight inward-bending, thereby enabling smooth pushing of the lock-detecting member and also smooth connecting of the connectors. Further, in the semi-connected state of the connectors, since insertion of the lock-detecting member is checked by a plurality of stop projections, even if the abutment between the detecting arms and the protecting walls are released, a strong abutting force is obtained and sure detection of the semi-connected state can be performed. Still further, the lock-detecting member provisionally engages the male connector at the vertical middle thereof, thereby enabling stable and smooth pushing of the lock-detecting member.

The above and other objects and features of the present invention will be more apparent from the following description taken in conjunction with the accompanying drawings.

BRIEF DESCRIPTION OF THE DRAWING FIGURES

DETAILED DESCRIPTION OF THE PREFERRED EMBODIMENT

An embodiment of the present invention will now be described in further detail with reference to the accompanying drawings.

Figure 1:
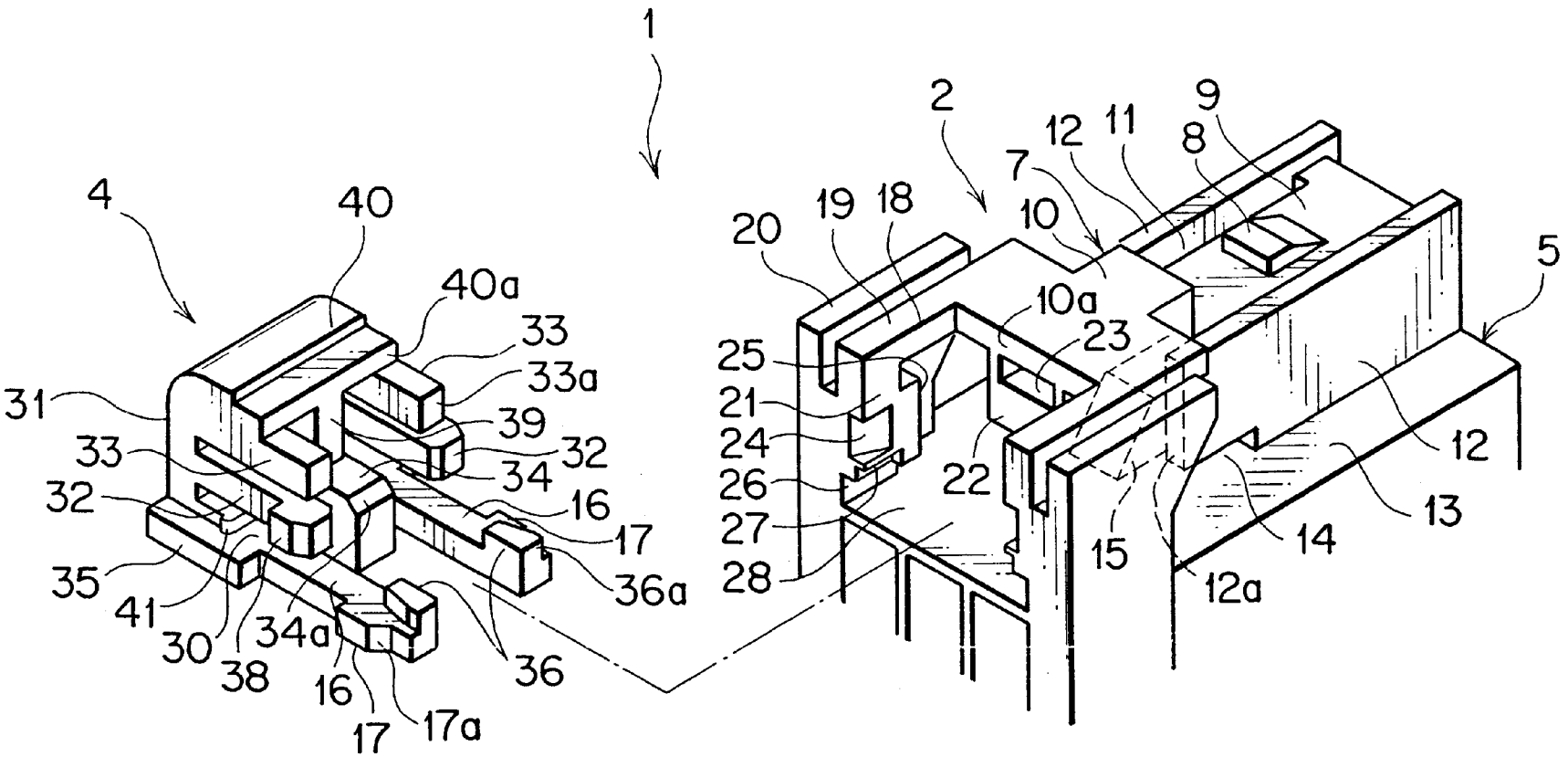
FIG. 1 is an exploded perspective view showing an embodiment of a male connector and of a lock-detecting member in accordance with the present invention.
Figure 2:
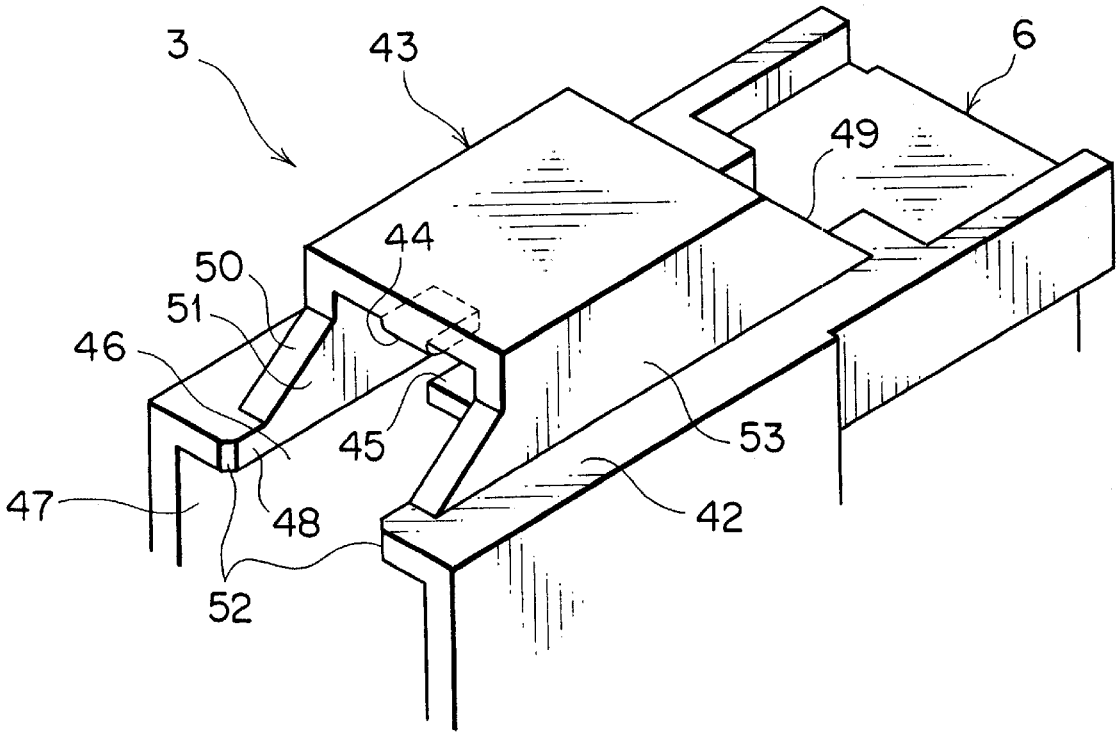
FIG. 2 is a perspective view showing an embodiment of a female connector in accordance with the present invention.

As shown in FIGS. 1 and 2, the lock-detecting connector 1 of this embodiment is made up of a male connector 2, a female connector 3, and a lock-detecting member 4 of synthetic resin attached to the male connector 2. The terminals in a male connector housing 5 and a female connector housing 6 each made of synthetic resin are now shown.

Referring to FIG. 1, a resilient locking arm 7 is formed on top of the male connector housing 5. The locking arm 7 has a body portion 9 with a locking projection 8 and a portion 10 above the arm-body portion 9.

Pairs of protecting walls (guide walls) 12, 12, and 20, 20 are provided respectively on both sides of the body portion 9 and of the portion 10. The protecting walls 12, 20 extend from a housing top wall 13. A short slit 14 is formed at the foot of each protecting wall 12 and a guide projection 15 relative to the lock-detecting member 4 is also formed in the middle of the housing top wall 13. The slit 14 is slightly larger than an outwardly-facing projection 17 on a detecting arm 16 of the lock-detecting member 4. The height of the outwardly-facing projection 17 is equal to thickness to the detecting arm 16.

A rectangular-like notched recess 18 is formed at the rear half of the portion 10 and a pair of slender resilient connecting portions 19, which are supported by columns formed integrally with the respective protecting walls 20, are disposed on both sides of the notched recess 18. A rectangular block-like interfering portion 22 is formed on the lower side integrally with the portion 10. The interfering portion 22 has a penetrated hole 23.

Inside the pair of columns 21 are formed tapered guide surfaces 24 relative to the lock-detecting member 4, engagement step-portions (engagement portions) 25 continuing the tapered guide surfaces 24, and big and small guide grooves 26, 27 both under the tapered guide surfaces 24. The lock-detecting member 4 is inserted into an accommodating space 28 formed with the notched recess 18 on the housing top wall 13.

The lock-detecting member 4 has a pair of detecting arms 16, 16 projecting from both sides of a base portion 30 in an insertion direction (front), a pair of provisional engaging arms 32, 32 disposed over the detecting arms 16 and projecting forwardly from both sides of a rear wall 31, a pair of first-stop projections (stoppers) 33, 33 disposed over the provisional engaging arms 32 and projecting forwardly from both sides of the rear wall 31, and a second-stop projection (stopper) 34 projecting forwardly from the lateral center of the base portion 30.

Sliding portions 35 relative to the guide grooves 26 project from both sides of the base portion 30. Each detecting arm 16 has the outwardly-facing projection 17 at the outer end for sliding use and an upwardly facing projection 36 at the top end thereof for abutting use. The outwardly-facing projection 17 has a guide tapered-surface 17*a*. The upwardly-facing projection 36 is formed in a substantially rectangular block-like shape on the detecting arm 16 and has a large abutting surface 36*a* at the end. The abutting surface 36*a* is capable of abutting on a rear end (upper side of the slit 14) 12*a* of the protecting wall 12 of the male connector 2.

The provisional engaging arm 32 extends to the middle of the detecting arm 16 and has a provisional engaging projection 38 at the outer end thereof. The provisional engaging projection 38 can engage the engagement step-portion 25 along the tapered guide surface 24 of the male connector 2. The first-stop projection 33 is formed in the shape of a rectangular column, and projects a shorter distance than the provisional engaging arm 32, and has an abutting surface 33*a* at the end. The abutting surface 33*a* can abut against a rear end surface 10*a* on both sides of the portion 10. The second-stop projection 34 is formed in the shape of a rectangular block, projects with the same length as the first-stop projection 33, has a height up to the middle of the provisional engaging arm 32, and has an abutting surface 34*a* at the top end thereof.

The abutting surface 34*a* can abut against a lower portion of the interfering portion 22 of the male connector 2.

A vertical wall 39 as a final stop, continuing to a short upper wall (drawing-operation portion) 40 of the detecting member 4, is formed above the second-stop projection 34. A front end 40*a* of the upper wall 40 is located facing the rear end 10*a* of the portion 10, and the vertical wall 39 is located facing the interfering portion 22. Above the base portion 30, a pair of small stopping projections 41 are formed on the both sides. The stopping projections 41 engage the guide grooves 27 and are capable of abutting on the end of the grooves 27.

As shown in FIG. 2, a hood portion 43 is provided that is capable of accommodating the body portion 9 of the locking arm 7 and the protecting walls 12 on a top wall 42 of the female connector housing 6. The top wall 42 has an opening 46 under the hood portion 43 in a connector connecting-direction. An engaging projection (engaging portion) 44 relative to the locking projection 8 of the locking arm 7 is provided inside the hood portion 43 at the front end thereof, and a guide projection 45 is provided in the hood portion 43 at the same level as the top wall 42. The guide projection 45 can proceed between the protecting walls 12. The opening (notched portion) 46 communicates with a connector-connecting chamber 47 located below.

Inwardly-facing sectional walls 48 on both sides of the opening 46 extend parallel to a hood rear wall 49. From the front end of hood side-walls 53 to the front end of the housing top wall 42, triangle-like ribs 50 are formed. Inner surface 51 of the hood portion 43 with the rib 50 and the inwardly-facing sectional wall 48 of the notched opening 46 are on the same place. At the front end of both of the inwardly-facing sectional walls 48, corner-portions (front corner-portions) 52 are formed so as to push the outwardly-facing projections 17 of the detecting arms 16. The front corner-portions 52 each have a small tapered section. The outwardly-facing projections 17 can slide from the corner-portions 52 along the inwardly-facing sectional walls 48 of the opening 46.

An operation of the lock-detecting connector 1 is described hereinafter.

Figure 3:
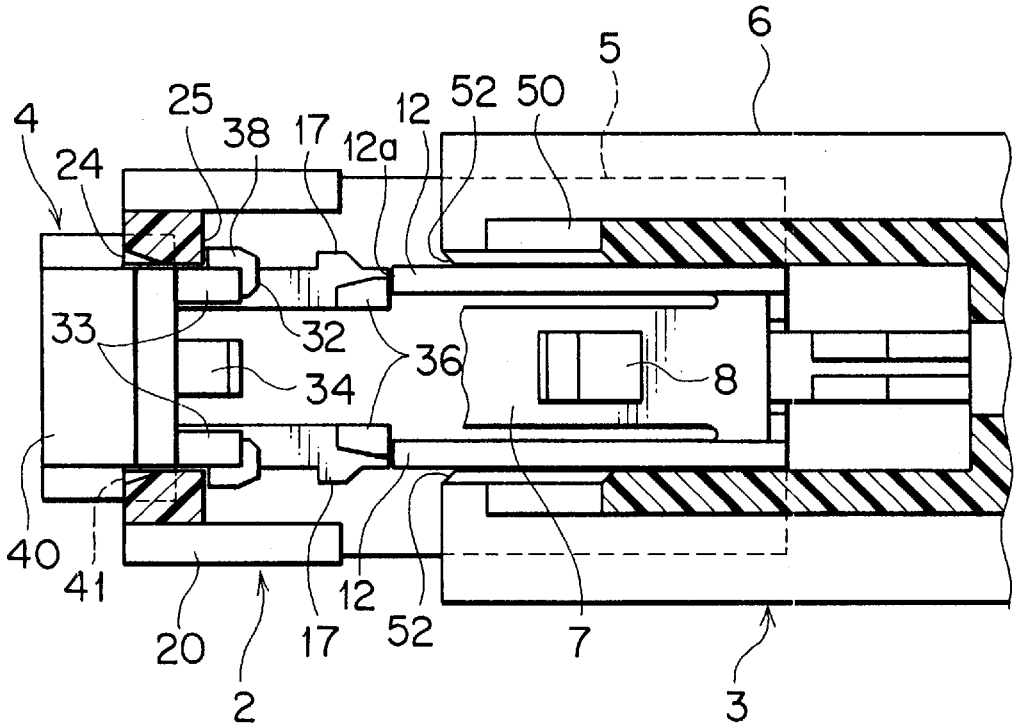
FIG. 3 is a plan view showing a provisionally engaged state of the lock-detecting member.
Figure 4:
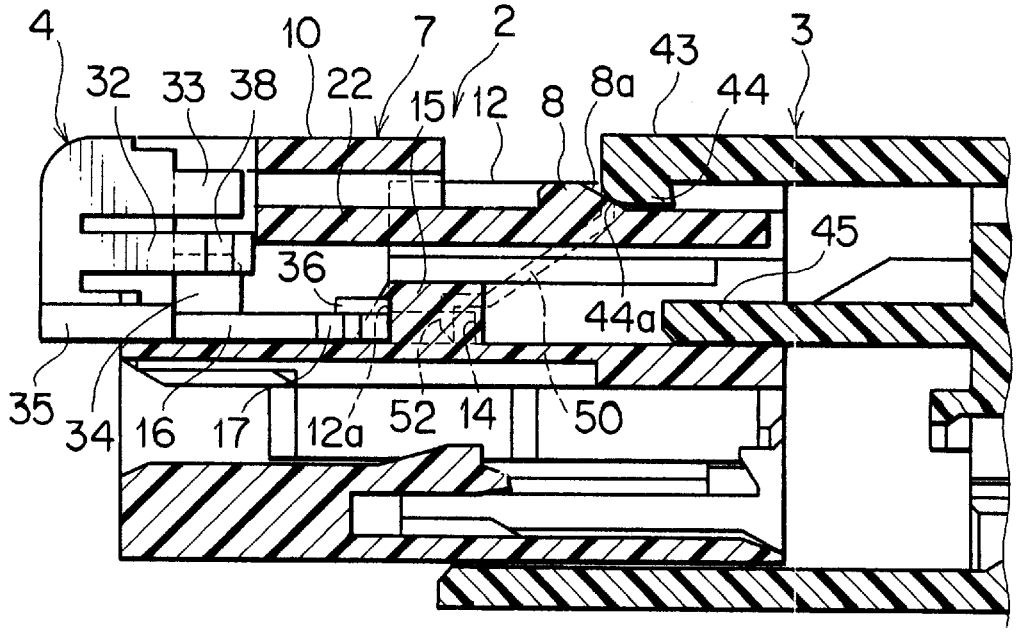
FIG. 4 is a longitudinal sectional view of FIG. 3.

As shown in FIGS. 3 and 4, the lock-detecting member 4 is provisionally engaged with the male connector 2.

More specifically, the outwardly-facing projections 38 of the provisional engaging arms 32 proceed along the respective tapered guide surfaces 24, while the arms 32 bend inwardly, and the projections 38 engage the engagement step-portions 25.

The upwardly-facing projections 36 of the pair of the detecting arms 16 abut on the rear ends 12*a* of the pair of protecting walls 12.

The outwardly-facing projections 17 of the detecting arms 16 project outwardly from the respective protecting walls 12. The stopping projections 41 of the detecting member 4 proceed to entrances of the respective guide grooves 27 (FIG. 1). As the female connector 3 makes an initial-connection with the male connector 2, the front tapered surface 8*a* on the locking projection 8 of the locking arm 7 abuts another front tapered surface 44*a* on the engaging projection 44 of the hood portion 43. Outer surfaces of the protecting walls 12 slide on inner surface of the hood portion 43.

Figure 5:
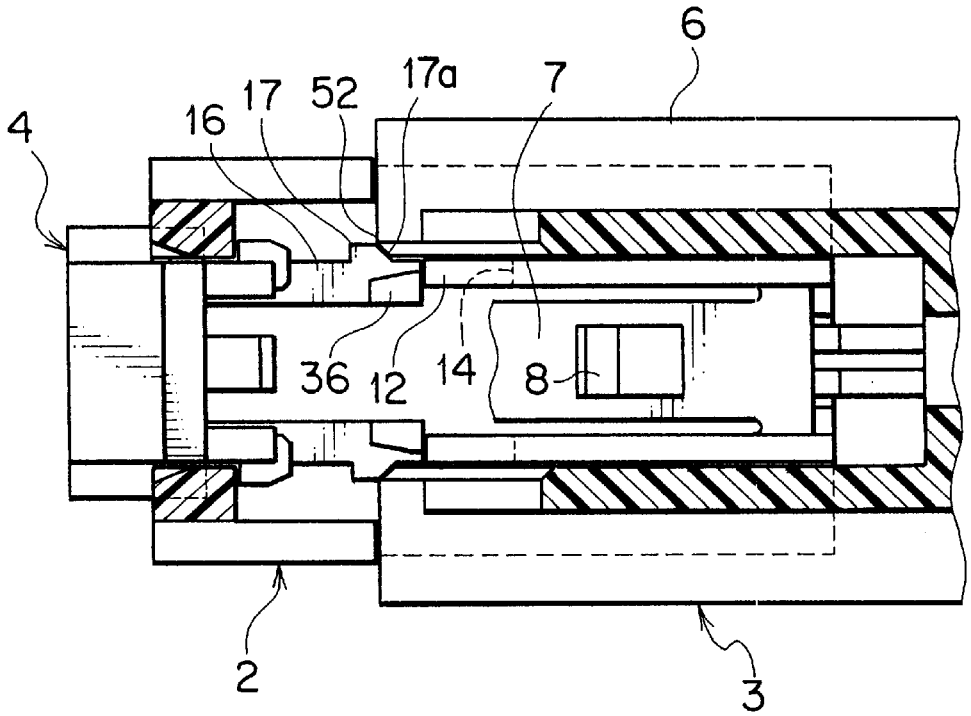
FIG. 5 is a plan view showing a contact-starting state between detecting arms and the female connector.
Figure 6:
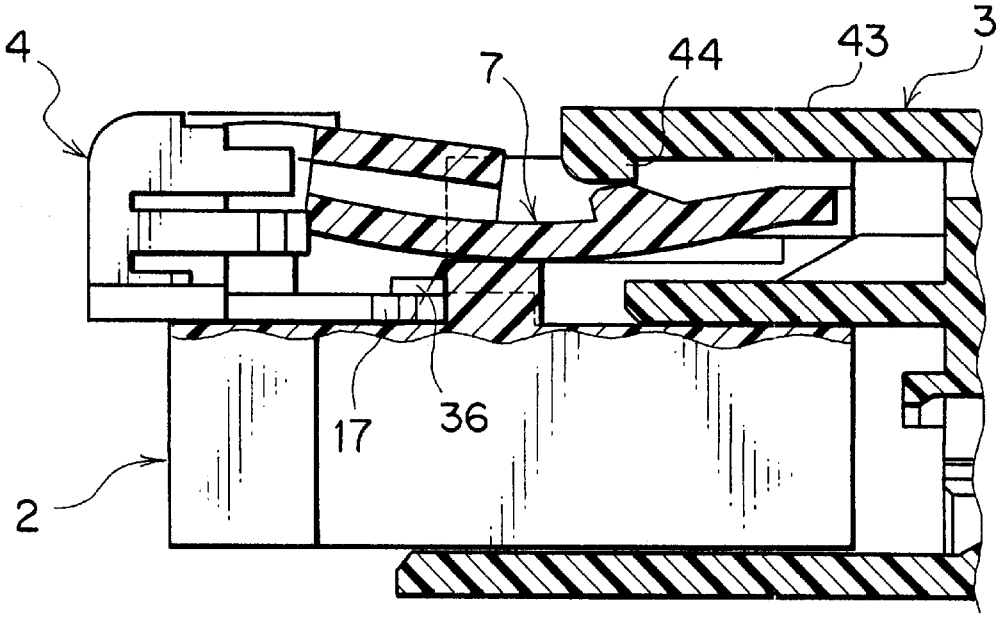
FIG. 6 is a longitudinal sectional view of FIG. 5.

On further connection of the connectors 2, 3 as shown in FIGS. 5, 6, the front corner-portions 52 of the female connector housing 6 abut the tapered guide surfaces 17*a* on the outwardly-facing projections 17 of the detecting arms 16.

The locking projection 8 on the locking arm 7 passes under the engaging projection 44 on the hood portion 43, while the locking arm 7 bends downward (FIG. 6).

Figure 7:
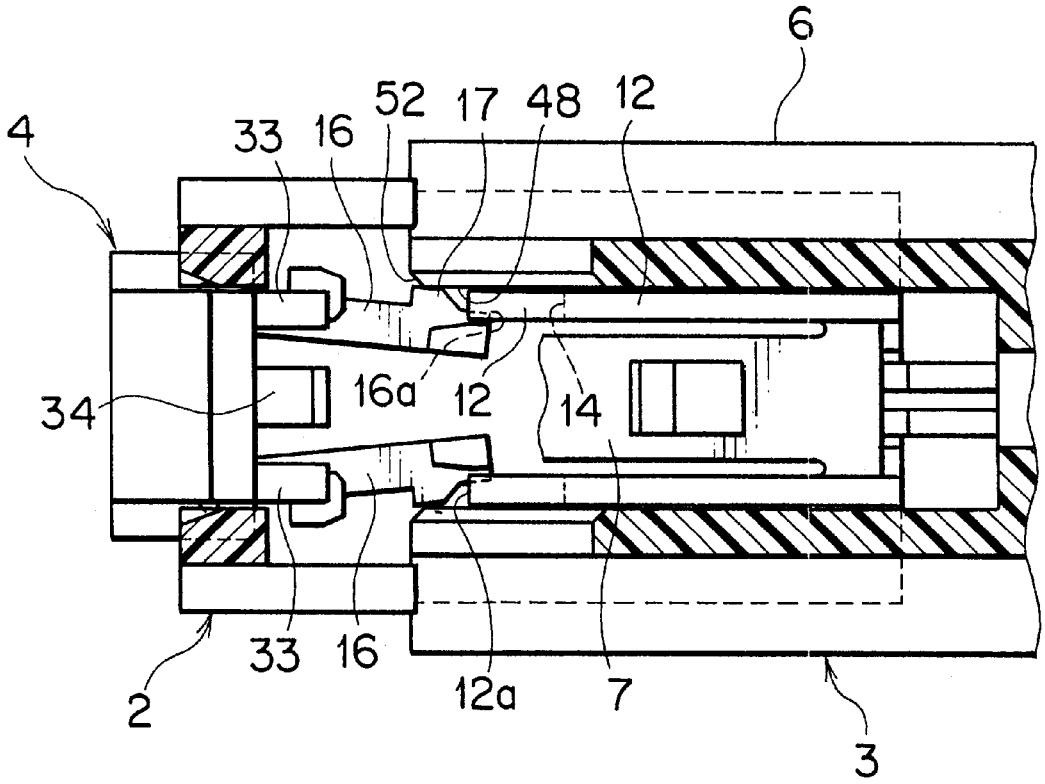
FIG. 7 is a plan view showing a state of the detecting arms bent inwardly.
Figure 8:
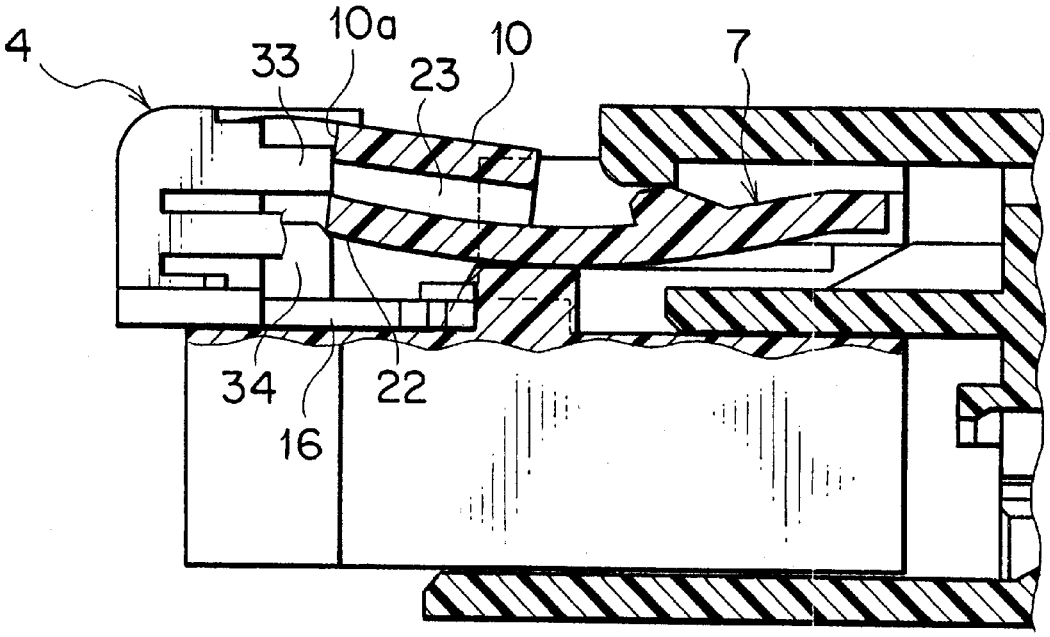
FIG. 8 is a longitudinal sectional view showing a state of the lock-detecting member abutting a locking arm.

On still further connection of the connectors 2, 3 as shown in FIGS. 7, 8, the outwardly-facing projections 17 on the detecting arms 16 are pushed by the front corner-portions 52 on the female connector housing 6, the detecting arms 16 bend inwardly, and the outwardly-facing projections 17 come into contact with the inwardly-facing sectional walls 48 facing the opening 46. A part of each arm front end 16*a* enters the slit 14 of the protecting wall 12. The upwardly-facing projections 36 on the detecting arms 16 are located in contact with inner surfaces 12*b* of the protecting walls 12. At this stage, an abutting area between the detecting arms 16 and the rear end 12*a* of the protecting wall 12 decreased gradually.

The locking arm 7 is still bent downwardly, and the connectors 2, 3 are in semi-connection (FIG. 8). Under this situation, the detecting member 4 cannot proceed since the stop projections 33, 34 of the detecting member 4 abut the rear end surface 10*a* and the interfering portion 22 both on the portion 10 caused by downwardly bending the portion 10 of the locking arm 7. The pair, right and left, of first-stop projections 33, 33 abut on the rear sides of the portion 10, and the second-stop projection 34 at the center abuts on lower portion of the interfering portion 22 of the portion 10. Here, the penetrated hole 23 of the portion 10 has no operative relation with the projections 33.

Sufficient detectability (i.e. abutting force) is obtained by means of three stop projections 33, 33, 34 so as to prevent the detecting member 4 from being inserted. The three stop projections 33, 33, 34 are arranged on vertexes of a triangle, which enables stable detection.

Figure 9:
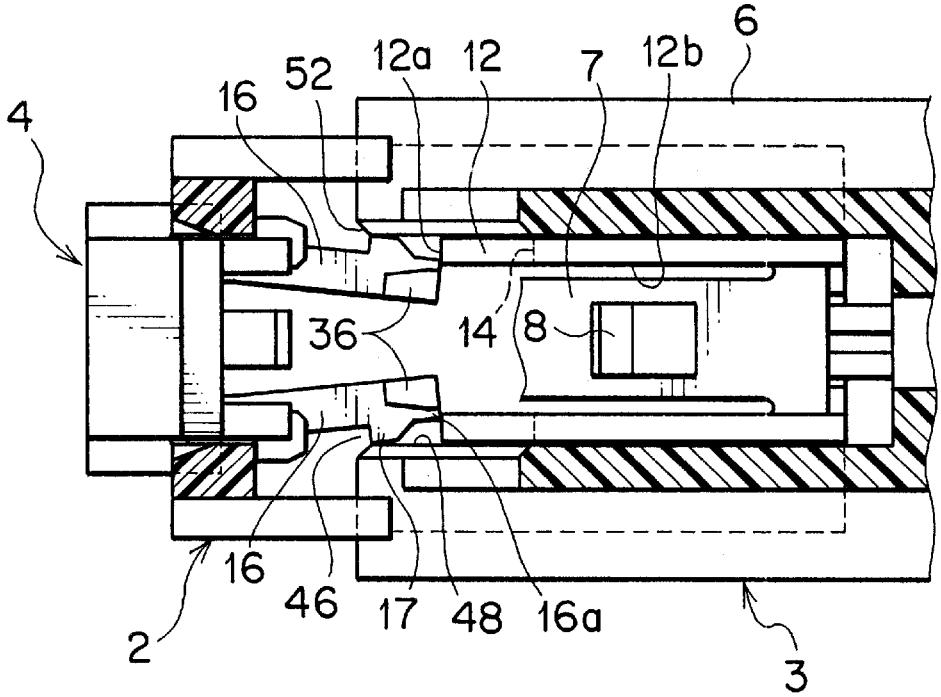
FIG. 9 is a plan view showing a completely connected state of the connectors.
Figure 10:
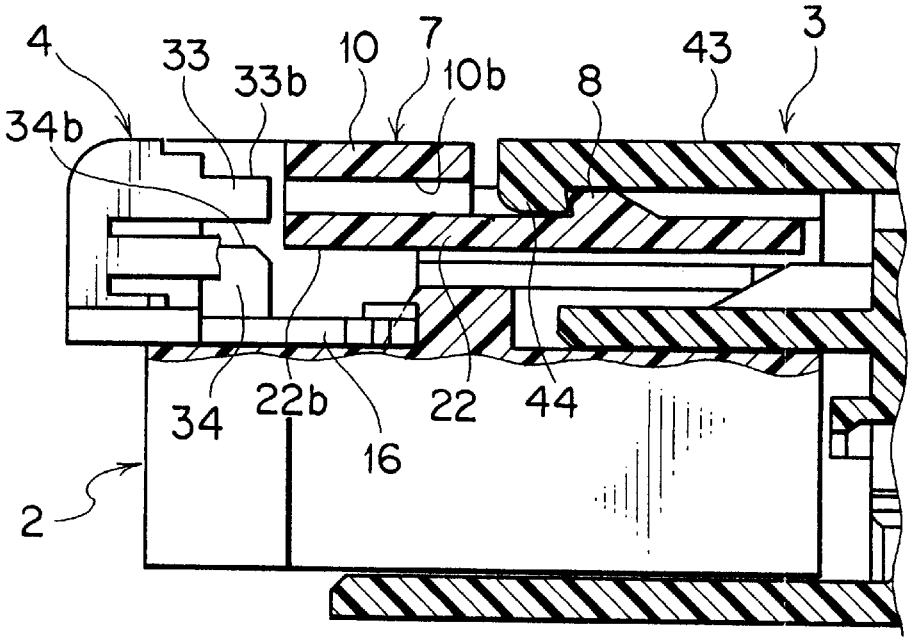
FIG. 10 is a longitudinal sectional view of FIG. 9.

On final connection of the connectors 2, 3 as shown in FIGS. 9, 10, the locking arm 7 resiles, and the locking projection 8 engages the engaging projection 44 on the hood portion 43. Upper surfaces 33*b* of the first-stop projections 33 are located slightly under a lower surface 10*b* of the portion 10, and another upper surface 34*b* of the second-stop projection 34 is also located slightly under another lower surface 22*b* of the interfering portion 22, so as to enable the three stop projections 33, 34 to proceed.

Here, the outwardly-facing projections 17 on the detecting arms 16 have slightly deeply entered along the inwardly-facing sectional wall 48 in the opening 46 of the female connector housing 6. The front ends of the detecting arms 16 are located nearer the center in partial contact with the rear ends 12*a* of the protecting walls 12, thereby enabling the outwardly-facing projections 17 and the arm front ends 16*a* to enter the respective slits 14 (FIG. 9).

Figure 11:
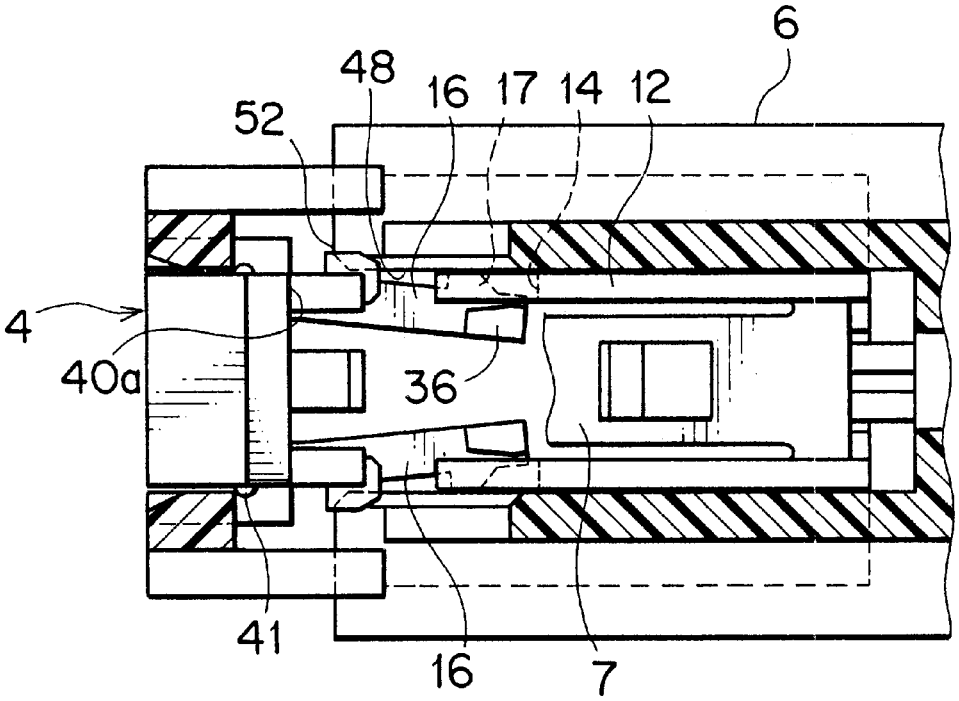
FIG. 11 is a plan view showing a state of the lock-detecting member fully inserted.
Figure 12:
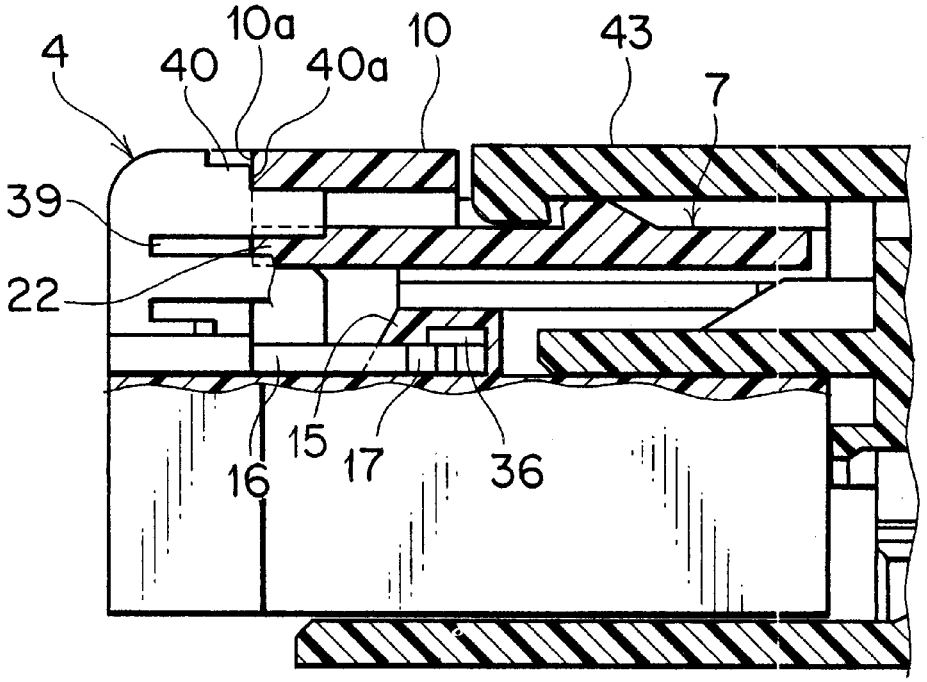
FIG. 12 is a longitudinal sectional view of FIG. 11.
Figure 13:
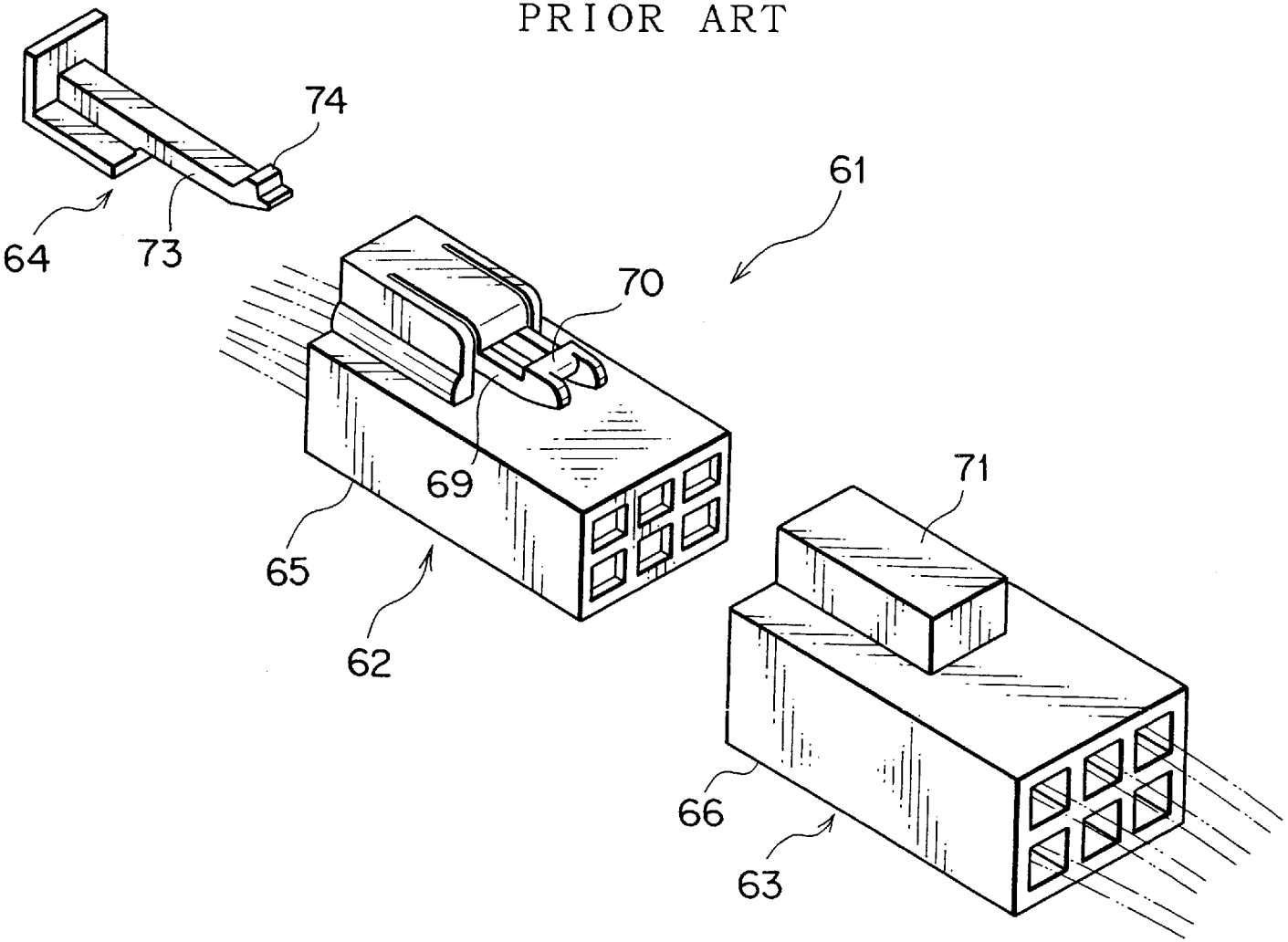
FIG. 13 PRIOR ART
FIG. 13 is an exploded perspective view showing a prior art lock-detecting connector.
Figure 14A:
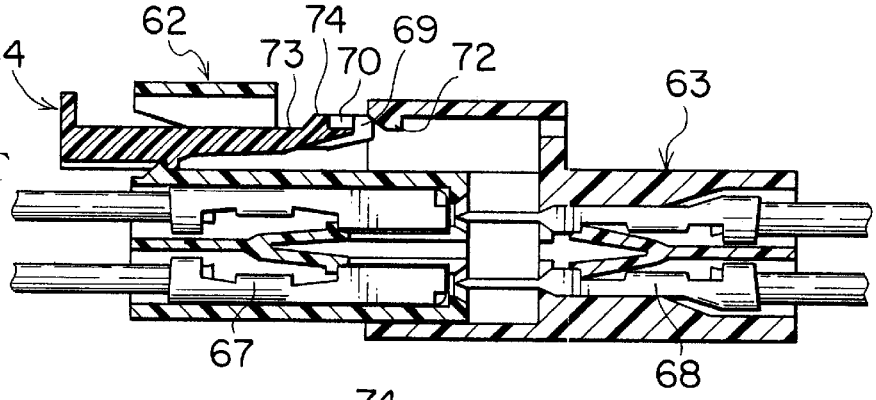
FIG. 14A PRIOR ART
FIGS. 14A to 14D are longitudinal sectional view showing operation of the prior art lock-detecting connector of FIG. 13.
Figure 14B:
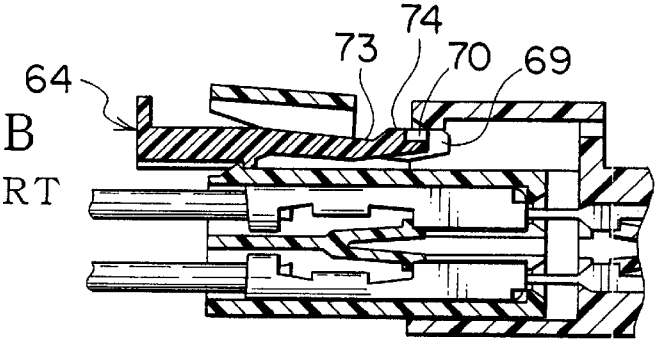
FIG. 14B PRIOR ART
Figure 14C:
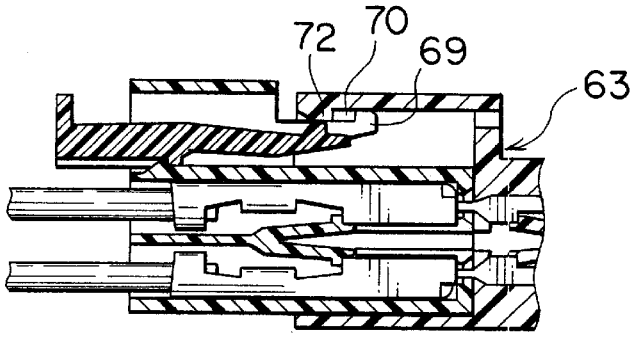
FIG. 14C PRIOR ART
Figure 14D:
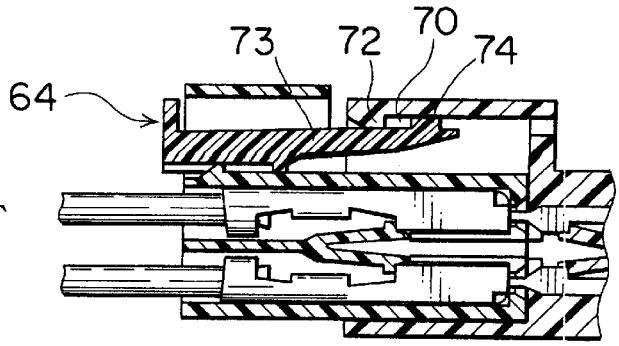
FIG. 14D PRIOR ART

As shown in FIGS. 11, 12, the detecting member 4 can be inserted in a completely connected state of the connectors. The pair of detecting arms 16, 16 proceed along both sides of the guide projection 15 inside the hood portion 43. The outwardly-facing projections 17 enter the slits 14 of the protecting walls 12, and the upwardly-facing projections 36 proceed along inner surfaces of the protecting walls 12.

On the outside of the outwardly-facing projections 17, are positioned inwardly-facing sectional walls 48 (FIG. 2) of the female connector housing 6. The stopping projections 41 abut on the ends of the guide grooves 27 (FIG. 1), the front end 40*a* of the upper wall 40 of the detecting member 4 abuts the rear end 10*a* of the portion 10 of the locking arm 7, and the vertical wall 39 abuts the interfering portion 22.

The outwardly-facing projections 17 are in contact with the inwardly-facing sectional walls 48 in the notched opening 46, thereby holding the detecting member 4. This enables elimination of a final engaging means, therefore, no releasing operation of such means is required. The detecting member 4 can be easily drawn back and returned to a provisionally engaged state by lightly pulling the upper wall 40 with a nail.

In the above-mentioned embodiment, the outwardly-facing projections 17 on the detecting arm 16 may be pushed by the front corner-portions 52 in the opening 46 and the projections 17 may slide along the inner surfaces of the protecting walls 12 by an operation of pushing the detecting member 4, without forming both of the slits 14 on the protecting walls 12 and the upwardly-facing projections 36 on the detecting arms 16. In this case, however, a deflection of the detecting arms 16 and force for pushing them increase.

What is claimed is:

1. A lock-detecting connector, comprising:

a male connector having a resilient locking arm and a pair of protecting walls on both sides of the locking arm, said protecting walls having respective flat rear ends;

a female connector having (1) an engaging portion to bend the resilient locking arm and to engage the resilient locking arm when said male connector is partially received and engaged in said female connector; and (2) an opening for receiving the protecting walls; and a lock-detecting member, placed on a rear portion of the resilient locking arm, having a pair of resilient detecting arms arranged to abut the respective flat rear ends of the pair of protecting walls in a semi-connected state of the male and female connectors with the lock detecting member abutting a resilient locking arms;

said pair of resilient detecting arms having respective transversely outwardly-facing projections, and front corner-portions having a tapered section, formed on both sides of the opening are capable of inwardly pressing said outwardly-facing projections upon insertion to inwardly bend said resilient detecting arms for releasing abutment of the resilient detecting arms on the respective flat rear ends of the protecting walls when the lock-detecting member is pushed into the male connector parallel to the direction in which the male and female connectors are connected; and wherein slits are provided on said protecting walls of said male connector for receiving said respective outwardly-facing projections on said resilient detecting arms, and said resilient detecting arms having upwardly-facing projections thereon arranged to abut on respective said projecting walls.

2. The lock-detecting connector according to claim 1, wherein an interfering portion is provided on a lower portion of a rear end of said resilient locking arm, and said lock-detecting member has a pair of first-stop projections and a second-stop projection arranged to abut on the rear end of the resilient locking arm and the interfering portion, respectively, when said resilient locking arm is bent downwardly.

3. The lock-detecting connector according to claim 1, wherein a lower portion of a rear end of said resilient locking arm has an interfering portion, and said lock-detecting member has a pair of first-stop projections and a second stop projection arranged to abut the rear end of the resilient locking arm and the interfering portion, respectively, when said resilient locking arm is bent downwardly.

4. The lock-detecting connector according to claim 2, wherein provisional engaging arms are provided between the detecting arms and the first-stop projections, and engagement step-portions are provided on the male connector to engage the respective provisional engaging arms.

5. The lock-detecting connector according to claim 3, wherein provisional engaging arms are provided between the detecting arms and the first-stop projections, and engagement step-portions are provided on the male connector to engage the respective provisional engaging arms.

6. The lock-detecting connector according to claim 1, wherein stopping projections are provided on the lock-detecting member and guide grooves having end walls are provided on the male connector so as to limit movement of the lock-detecting member by contact with said stopping projections on the end walls of said guide grooves.

7. The lock-detecting connector according to claim 1, wherein sliding projections are provided on the lock-detecting member and guide grooves are provided on the male connector so as to push the lock-detecting member into the male connector along said guide grooves.

* * * * *